US009399852B2

(12) United States Patent
Northrop

(10) Patent No.: US 9,399,852 B2
(45) Date of Patent: Jul. 26, 2016

(54) PILE INSTALLATION WITHOUT EXTRACTION

(71) Applicant: Alternative Energy Development Corp., Fort Lee, NJ (US)

(72) Inventor: Thad Northrop, Fresno, CA (US)

( * ) Notice: Subject to any disclaimer, the term of this patent is extended or adjusted under 35 U.S.C. 154(b) by 0 days.

(21) Appl. No.: 14/919,255

(22) Filed: Oct. 21, 2015

(65) Prior Publication Data

US 2016/0108597 A1 Apr. 21, 2016

Related U.S. Application Data

(60) Provisional application No. 62/066,485, filed on Oct. 21, 2014.

(51) Int. Cl.

| | |
|---|---|
| ***E02D 13/08*** | (2006.01) |
| ***E02D 7/02*** | (2006.01) |
| ***E02D 7/30*** | (2006.01) |
| ***E02D 7/06*** | (2006.01) |
| ***E02D 7/22*** | (2006.01) |
| ***E02D 27/12*** | (2006.01) |
| ***E02D 27/32*** | (2006.01) |

(52) U.S. Cl.

CPC .. *E02D 7/30* (2013.01); *E02D 7/02* (2013.01); *E02D 7/06* (2013.01); *E02D 7/22* (2013.01); *E02D 13/08* (2013.01); *E02D 27/12* (2013.01); *E02D 27/32* (2013.01)

(58) Field of Classification Search

CPC ..... E02D 7/02; E02D 7/04; E02D 7/06; E02D 7/08; E02D 7/10; E02D 7/26; E02D 13/08

See application file for complete search history.

(56) References Cited

U.S. PATENT DOCUMENTS

| | | | | |
|---|---|---|---|---|
| 3,507,342 | A | 4/1970 | Hasewend et al. | |
| 3,886,754 | A * | 6/1975 | Turzillo | E02D 7/26 405/239 |
| 4,222,684 | A * | 9/1980 | Rosenstock | E02D 17/16 405/232 |
| 4,257,722 | A * | 3/1981 | Nakajima | E02D 7/24 405/232 |
| 4,550,786 | A * | 11/1985 | Rosenstock | E02D 7/00 102/312 |
| 5,176,472 | A * | 1/1993 | Kinder | E02D 35/00 405/230 |
| 5,386,878 | A | 2/1995 | Rowekamp | |
| 6,668,946 | B2 | 12/2003 | Rankin et al. | |
| 8,671,930 | B2 | 3/2014 | Liao | |
| 2005/0281625 | A1 * | 12/2005 | Mignacca | E02D 5/72 405/255 |
| 2012/0216852 | A1 | 8/2012 | Almy et al. | |
| 2014/0090638 | A1 | 4/2014 | Grushkowitz | |

OTHER PUBLICATIONS

Brochure "Foundations" by Grupo CLAVIJO ELT. SL., www.grupoclavijo.net, 4 pages.

Halco Rock Tools, "A-Z of Drilling", halcorocktools.com.

* cited by examiner

*Primary Examiner* — Frederick L Lagman

(74) *Attorney, Agent, or Firm* — Jeffrey B. Fabian; Shumaker, Loop & Kendrick, LLP

(57) ABSTRACT

A method of installing a support pile when refusal is encountered comprising the steps of: side drilling a ground surface proximate to a support pile to a predetermined embedment depth; thereby creating a void; driving the support pile to a predetermined embedment depth; and backfilling the void using a suitable filler material.

18 Claims, 11 Drawing Sheets

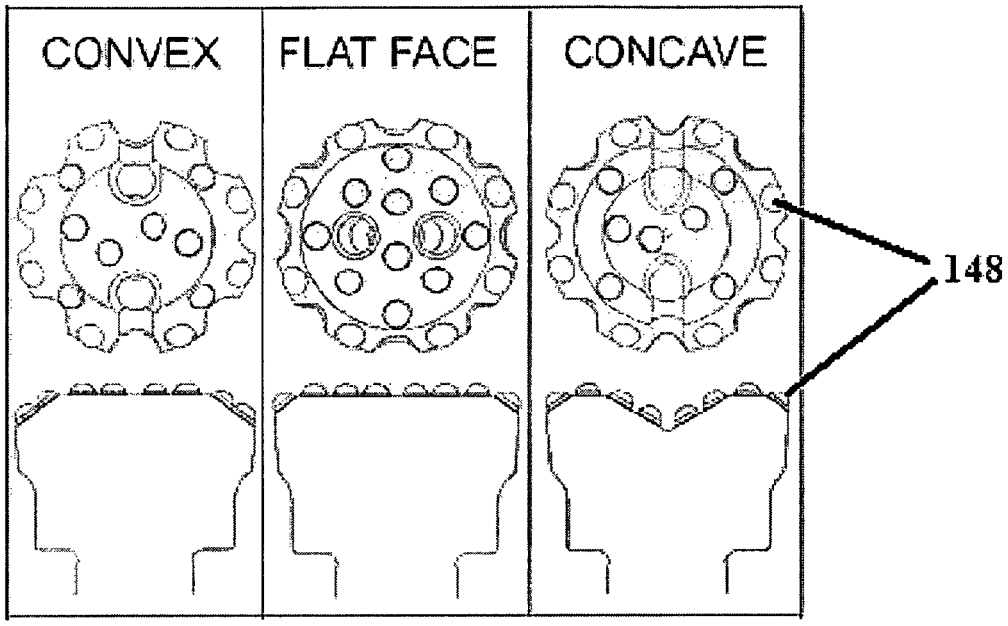
*FIG. 7A* *FIG. 7B* *FIG. 7C*

PILE INSTALLATION WITHOUT EXTRACTION

CROSS REFERENCE TO RELATED APPLICATIONS

This application is a Non-Provisional Application of co-pending U.S. Patent Application 62/066,485, filed Oct. 21, 2014; which application is fully incorporated herein by reference.

TECHNICAL FIELD

The present invention relates generally to the installation of support piles, and more particularly, to methods for installing support piles in renewable energy systems when pile refusal is encountered.

BACKGROUND OF THE INVENTION

Renewable energy systems, such as utility-scale solar tracker arrays, must be constructed so as to resist strong winds and other environmental loads. The load capacity of a solar tracker array depends on, among other factors, ground conditions at the installation site, support pile height, pile construction, pile depth, and the use of filler material surrounding the pile. The lower the structure, the better wind resistance it achieves. Lower structures also permit the use of smaller solar tracker components that are less expensive to install and maintain.

Support piles are installed by using a pile driver to drive the piles to a predetermined embedment depth. Variations in ground conditions at the installation site can create challenging conditions for pile installation. To illustrate, the ground may be composed of a soft soil layer covering rock strata of varying depths, density, hardness, and materials, including, for instance, clay, shale, caliche, sandstone, granite, and limestone. Pile refusal may be encountered during pile driving if the pile is being driven through ground materials of particular hardness.

With traditional methods of pile installation, when a pile is refused, it must be extracted from the ground so that a borehole can be drilled to receive the support pile. The pile is installed in the borehole, and the borehole is backfilled with filler material. This increases the installation time and leads to undesirable cost over runs and construction delays. It would, therefore, be advantageous to provide a method for installing piles that does not require extraction in the event of pile refusal.

Accordingly, it is an object of the present invention to provide methods for installing a support pile without extraction that utilizes side drilling to break up refusal materials and to create a void for compaction of the refusal materials during subsequent pile driving.

SUMMARY OF THE INVENTION

In a first embodiment the invention includes a method of installing a pile by establishing a desired depth for the leading end of the pile and then driving a pile through a first substrate to a first position where the leading end of the pile contacts a second substrate at least partially comprising a refusal material (which is any material which prevents further advancement of the pile). A bore is drilled with a drill string at an angle relative to the pile such that the leading end of the drill string creates a bore in the second substrate at a point below the leading end of the pile. The drill string is then withdrawn and driving of the pile continues into the bore created by the drill string.

In one embodiment the drill string creates a bore extending to the desired depth for the leading end of the pile. In an alternate embodiment the drill string creates a bore terminating at a point between the leading end of the pile when the pile is in the first position and the desired depth for the leading of the pile.

The pile reaches the desired depth by driving the pile through the first and second substrates until the leading end of the pile reaches the desired depth.

In embodiments wherein the pile is an I-Beam having a pair of flanges, the drill string drills a bore at an angle between the pair of flanges. In such embodiments, preferably, the bore is drilled using a four (4) inch down-the-hole (DTH) hammer drill bit.

In another embodiment the angle at which the drill string drills the bore is such that the drill string is within about six (6) inches of the pile at its closest point. In a preferred embodiment the bore is drilled using a down-the-hole (DTH) hammer drill.

BRIEF DESCRIPTION OF THE DRAWINGS

Features, aspects, and advantages of the present invention are better understood when the following detailed description of the invention is read with reference to the accompanying figures, in which:

FIGS. 7A-7C depict different configurations for a down-the-hole hammer drill bit;

DETAILED DESCRIPTION

Figure 1:
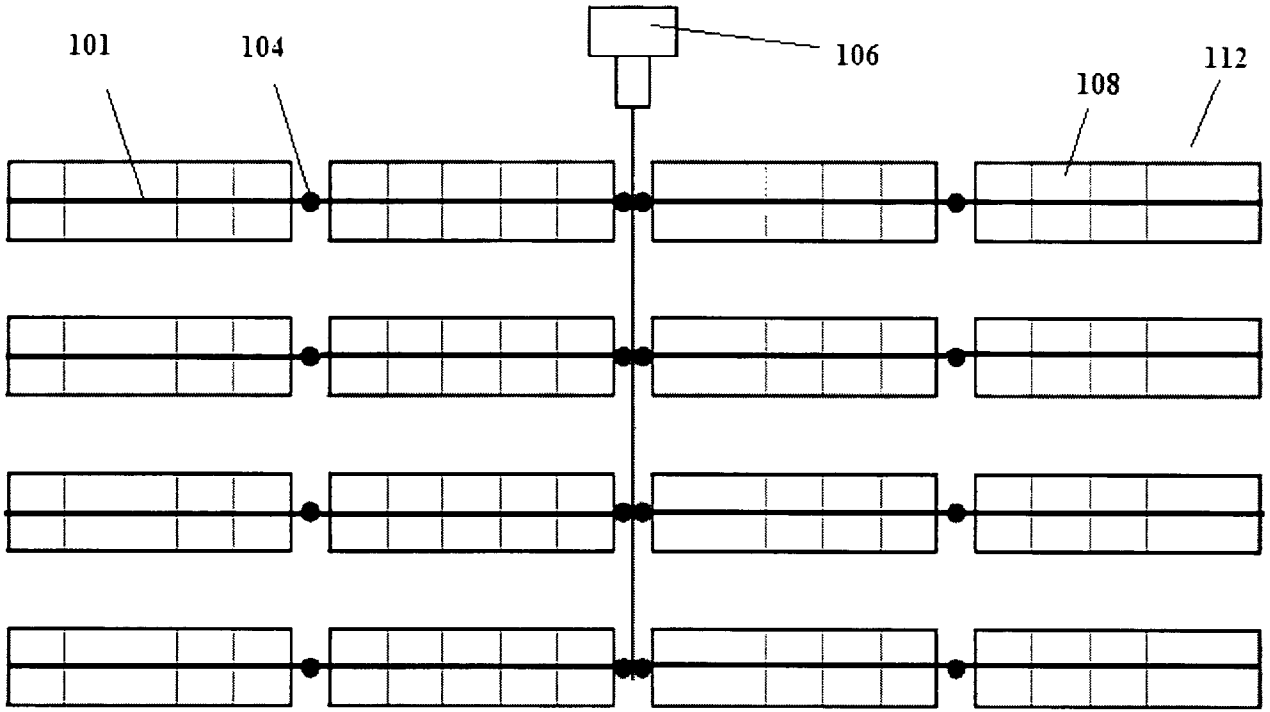
FIG. 1 is a top view of an exemplary configuration for a solar tracker array.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use, and practice the invention.

Certain terminology may be used in the following description for the purpose of reference only, and thus are not intended to be limiting. For example, terms such as "upper," "lower," "above," and "below" refer to directions in the drawings to which reference is made. Terms such as "front," "back," "rear," and "side" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Disclosed are methods for installing piles whereby the pile does not need to be extracted for drilling a borehole in the event of pile refusal. The methods find particular application for the installation of support piles in solar tracker arrays. But those of ordinary skill in the art will appreciate that the methods can be applied to pile installation generally across a number of industries, including, for example, the installation of wind turbines or load bearing piles of various other structures (e.g., guard railings, streetlights, bridges, etc.).

Piles are driven to a predetermined embedment depth using a pile driving machine. With traditional methods of pile installation, if pile refusal is encountered, the pile will need to be extracted so that a borehole can be drilled for receiving the pile. However, using the inventive methods described herein, the ground surrounding the pile can be drilled to break up the materials causing the refusal and to create a void that facilitates driving the pile to embedment depth. The side-drilled void is backfilled with appropriate filler material (e.g., sand or cementitious material) so that the surface surrounding the pile is level with the existing ground.

Figure 2:
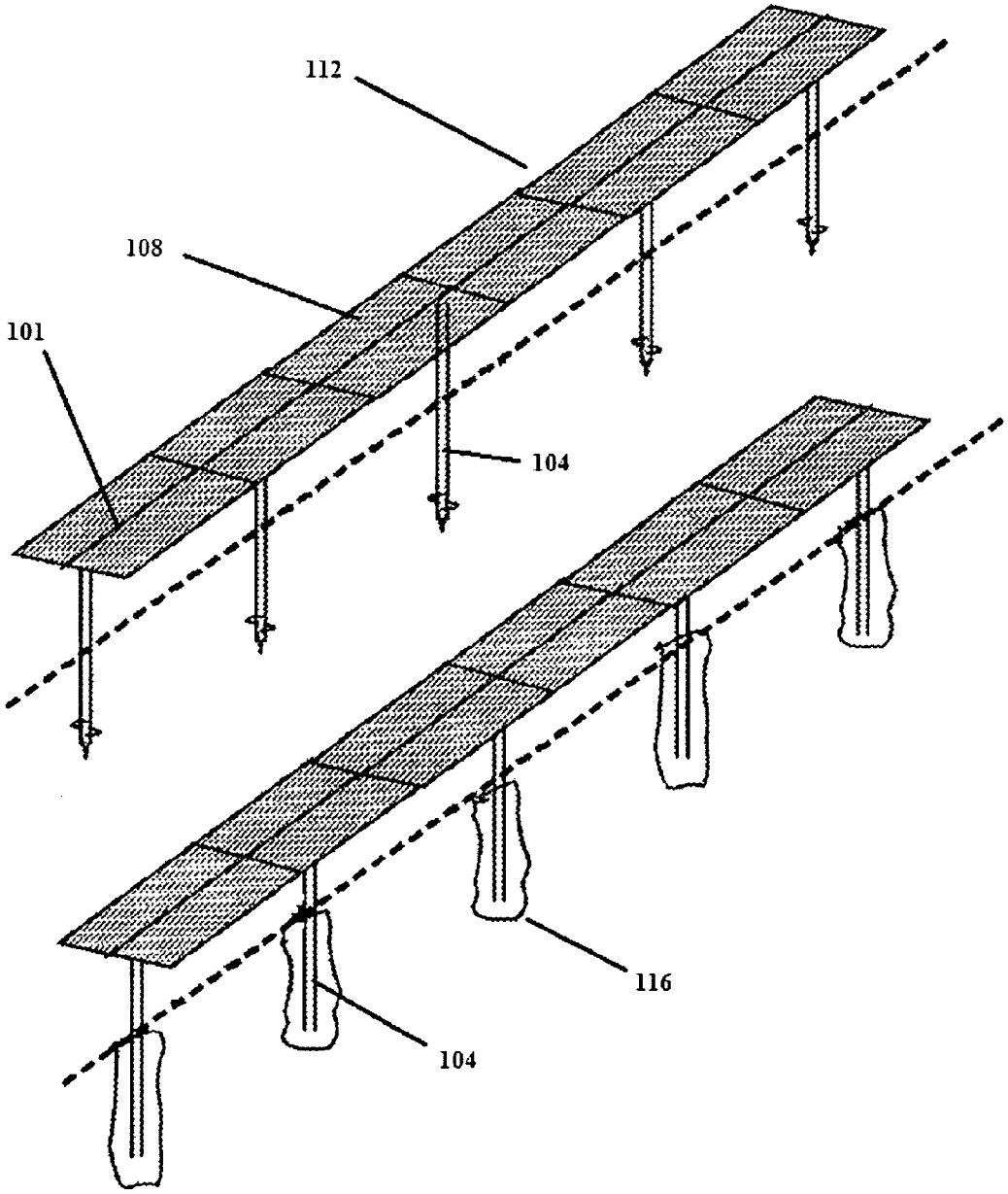
FIG. 2 is a perspective view of a solar tracker array.

Exemplary solar tracker arrays are illustrated in FIGS. 1-2 and include photovoltaic cells (e.g., solar panels) 108 that are assembled into modules 112. The solar modules 112 are mounted to a torque tube 101 that is rotated using a drive motor 106. The torque tube 101 is supported by a plurality of piles 104 that are installed into the ground at a predetermined embedment depth. The embedment depth is determined by, among other factors, wind load requirements and terrain conditions. For instance, piles can be embedded deeper to meet increased load requirements or to accommodate soft ground conditions. The piles 104 can optionally be surrounded by a filler material 116 for added rigidity. Suitable filler materials 116 include, but are not limited to, cement, concreate, rocks, or sand slurry.

Figure 3:
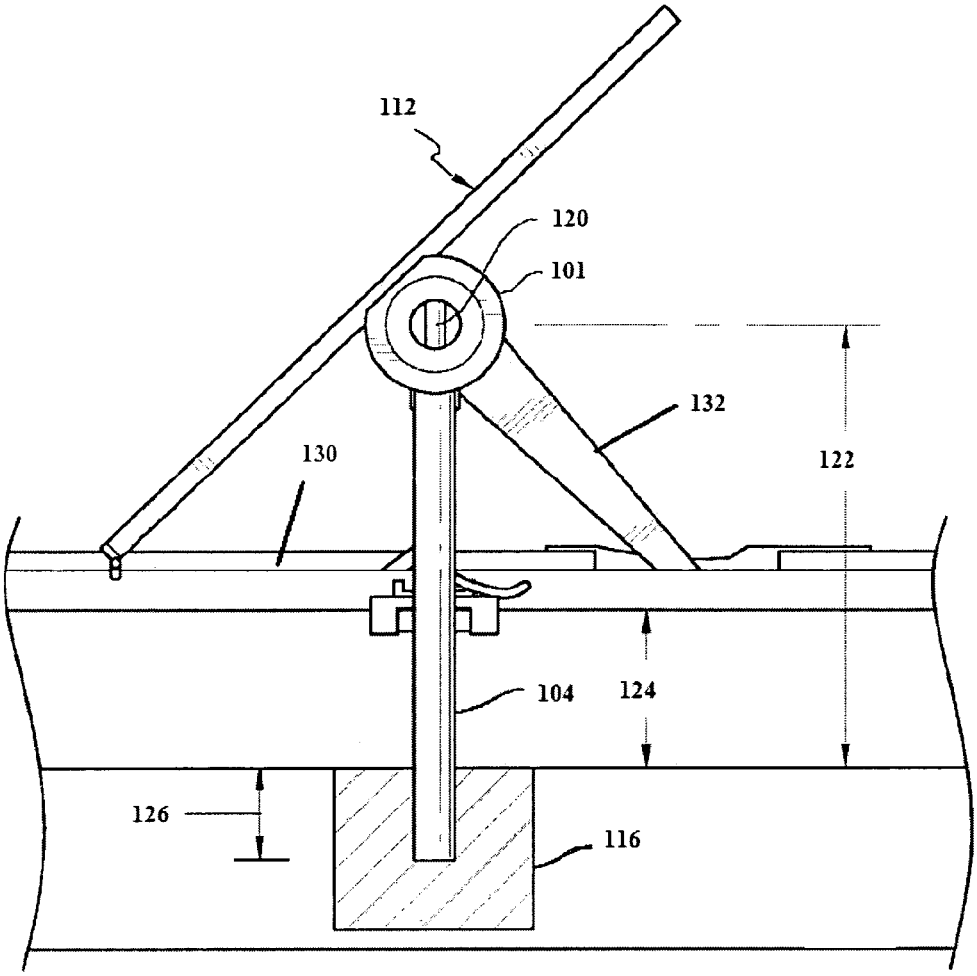
FIG. 3 is a side view of a solar module array.

The solar tracker module embodiment depicted in FIG. 3 utilizes a torque arm assembly 132 and a drive strut 130 connected to the drive motor 106 for rotating the torque tube 101 and solar module 112 about a rotation axis 120. The pile height and embedment depth 126 are chosen such that the modules 112 do not collide with the ground or other system components while rotating. The pile 104 material, dimensions, cross sectional shape, embedment depth 126, and filler material 116 are chosen to withstand a predetermined maximum wind load. The maximum wind load applied to the piles 104 is directly proportional to the height 122 of the rotation axis 120 considering the predetermined maximum wind speed and aerodynamics of the module 112 and torque tube 101. The pile 104 can be made from any suitable material known to those of ordinary skill in the art, including, for example, concreate or galvanized steel. The piles 104 can utilize a variety of cross sectional shapes, such as circular, square, rectangular, T-beam, L-beam, or I-beam.

Figure 4:
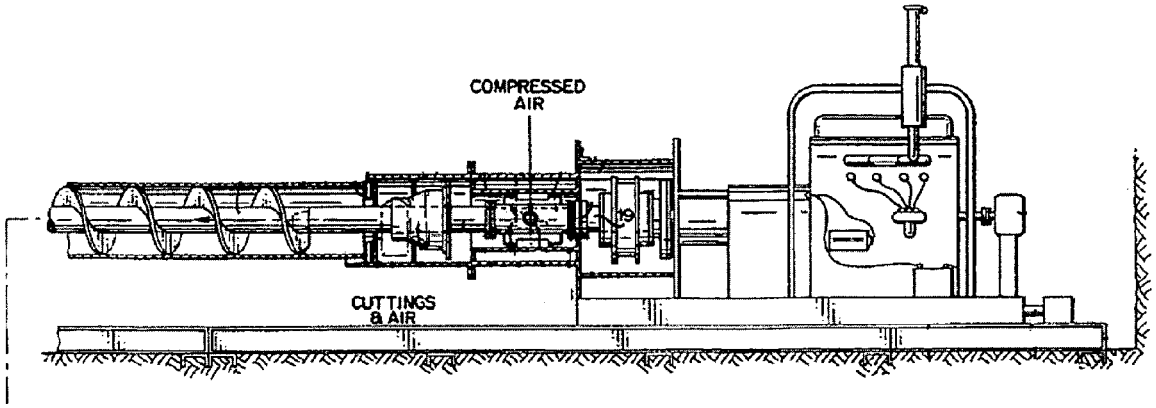
FIG. 4 is an exemplary auger drilling assembly.
Figure 5:
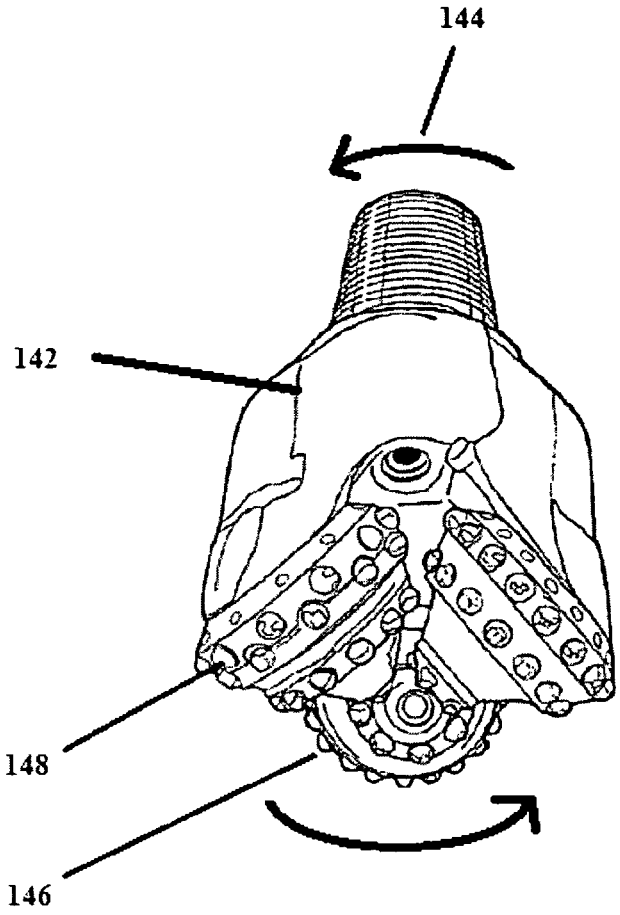
FIG. 5 is an exemplary rotary drilling assembly.

The piles 104 are installed by first driving the pile to the specified embedment depth using a pile driving machine. An exemplary pile driving machine is shown in FIGS. 4-5. Pile driving machines generally include a heavy weight, such as a piston or hammer, situated on a track so that the weight freely slides up and down in a single line. The weight is raised above the pile using hydraulics, steam, or diesel engines. The weight is released and/or driven downward onto the pile to drive the pile into the ground. The weight is repeatedly raised and driven onto the top of the pile until the pile reaches the desired depth. The pile driving machine can be mobilized by mounting it on an appropriate rig or vehicle, such as a skid-steer.

Pile refusal may be encountered before the embedment depth is reached if the terrain includes a shelf or strata of hard mineral materials, such as caliche, limestone, or granite. If pile refusal is encountered, the pile 104 can be extracted using a pile driver with an extractor attachment. In some cases, additional extraction equipment is needed based on soil conditions and uplift forces needed to remove the pile 104. For instance, an excavator or other large equipment may be required to extract a pile 104 if it becomes lodged in hard material. Upon pile extraction, a borehole is drilled to the specified embedment depth to allow for removal or break up of the refusal material.

Any suitable drill can be used to drill the boreholes, including an auger-type drill, a rotary drill, or a down-the-hole ("DTH") hammer drill. The drill type is determined based on a variety of factors, such as the desired borehole depth, drill speed, and hardness of the terrain. Auger and rotary drilling generally work well for softer surfaces while percussion rotary air blast drilling ("RAB drilling"), also known as DTH hammer drilling, can be more efficient for drilling into harder surfaces.

In many cases, an auger drill will be sufficient for locations with gravel and cobble. For areas with larger rock and boulders, air operated DTH hammer drills will be required. Any rock larger than cobble will often require rock drilling equipment. The required borehole diameter is determined based on load requirements, pile 104 diameter, and whether a ballast is needed. The diameter of the borehole is measured at 18 to 24 inches below grade. The top 18 to 24 inches is negated in the design calculations and is, therefore, not used as the location for borehole diameter measurement.

The drill can be attached to a mobile unit called a rig. The rig contains a power unit, such as a gasoline or electric motor with a hydraulic pump or compressor. For top drive rigs, drill rotation and circulation is generated at the top of the drill string using a motor that moves in a track along the rig. The drill components include a drill bit, a drill collar (i.e., a thick-walled tube used to apply weight to the drill bit), and a drill pipe connected between the drill collar and the rig. The drill bit, collar, and pipe are collectively referred to as the "drill string."

Auger drilling is done with a helical screw that is driven into the ground with rotation. The earth is lifted up the borehole by the blade of the screw. Hollow stem auger drilling is used for softer ground where the hole will not stay open by itself for environmental drilling.

An exemplary rotary drill and rotary drill bit 142 are shown in FIG. 5. Rotational drilling relies on high rotational speeds and thrust without percussion. As a result of the high thrust or downforce required for rotary drilling, rotary drill bits and the accompanying rigs may need to be significantly larger than DTH hammer drills of comparable drilling capacity. For the rotary drill shown in FIG. 5, the drill string 140 rotates 144 the rotary drill bit 142 while the cutters 146 simultaneously rotate and contact the borehole surface perpendicular to the drilling direction.

Figure 6A:
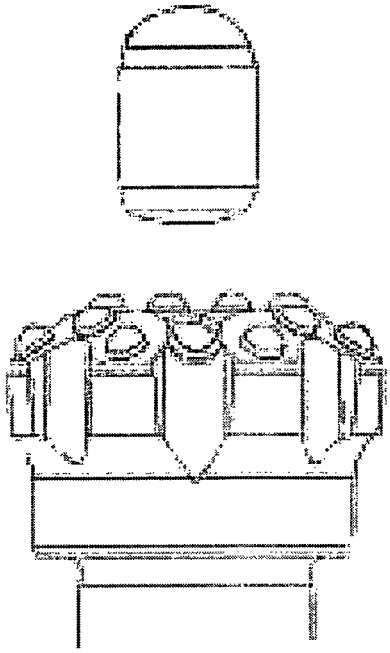
FIGS. 6A-6C depict different configurations for a drill bit button inserts.
Figure 6B:
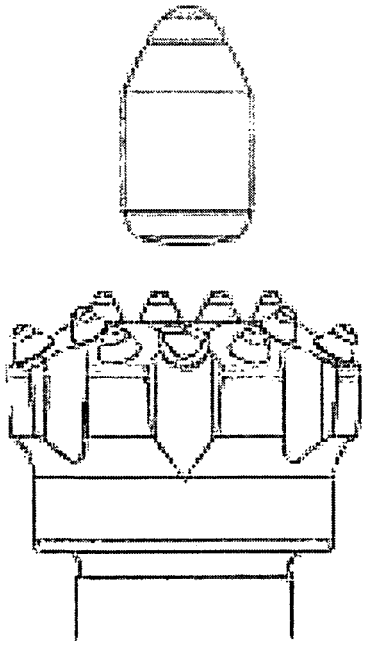
Figure 6C:
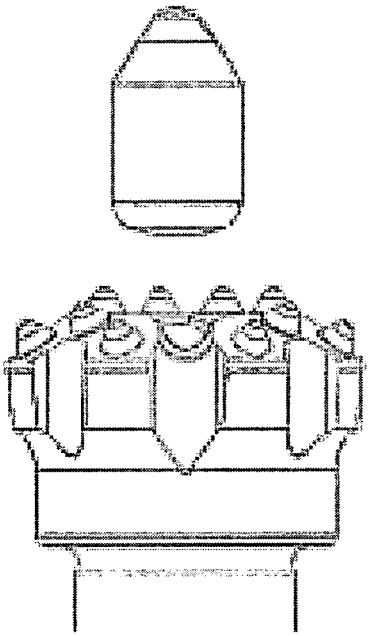
Figure 8A:
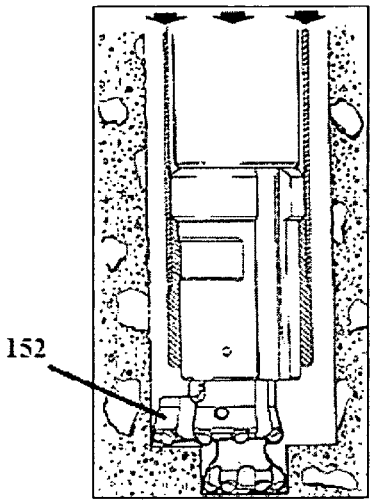
FIGS. 8A-8D illustrate an exemplary method for down-the-hole hammer drilling.
Figure 8B:
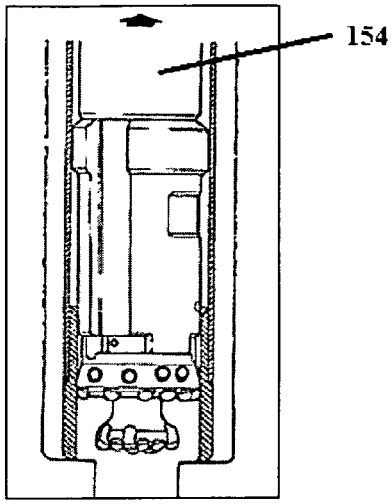
Figure 8C:
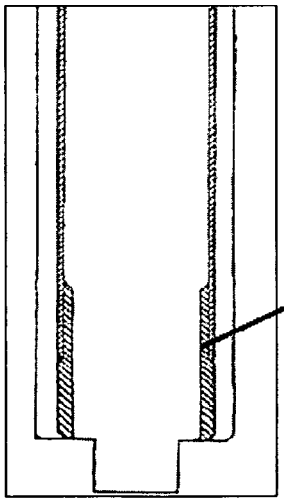
Figure 8D:
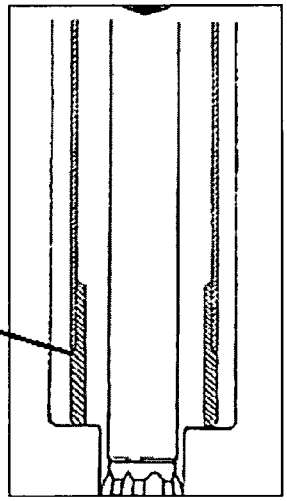

The rotatory drill bit 142 optionally includes one or more button inserts 148 protruding from the cutters 146 that serve as the cutting face of the drill bit 142. The buttons 148 are approximately cylindrical and can utilize domed, ballistic, or semiballistic shaped heads, as illustrated in FIGS. 6A-C. Domed inserts (FIG. 6A) are strong, rugged and shaped for high performance and good service life in all conditions. Domed inserts are particularly suitable for very hard abrasive rocks and deep hole drilling. Ballistic inserts (FIG. 6B) are suitable for soft-to-medium compact low abrasive rocks and produce large cuttings. They are not suitable for badly structure rocks. Semi-ballistic inserts (FIG. 6C) are suitable for all soft-to-medium rock conditions including fractured and fissured rocks.

The buttons 148 are ground to close tolerances and pressed into the drill bit 142. The buttons can be made of tungsten carbide to avoid unnecessary abrasion and damage to the drilling equipment; though, skilled artisans will appreciate that other materials can be used.

DTH drilling uses a reciprocating, piston-driven hammer to energetically drive a heavy drill bit into the rock. "Down-the-hole" refers to the location where the hammer action occurs when compared to conventional hammer drills, which hammer on the top of the drill string. For DTH hammer drills, the hammering occurs at the drill bit, thereby reducing the transmitted energy loss as the hammer drills deeper. Penetration rates for DTH hammers are almost directly proportional to the applied air pressure. The cuttings are blown up the outside of the rods and collected at surface. Air or a combination of air and foam lift the cuttings. Exemplary drill bits for a DTH hammer drill are depicted in FIGS. 7A-C. Like the rotary drill bits, DTH hammer drill bits optionally include one or more button inserts 148. Convex bits (FIG. 7A) are strong and designed for all conditions, especially hard abrasive rocks. They provide god balance for fast drilling. Flat face bits (FIG. 7B) are an alternative design for all rock conditions especially fractured and fissured rocks and changing formations. Concave bits (FIG. 7C) are designed for all rock conditions, particularly deep hole drilling. Concave bits can improve bore alignment as a result of the inverted pilot.

DTH hammer drills can be adapted to soft conditions using the exemplary drilling process shown in FIGS. 8A-D. The DTH hammer drill bit creates a smaller borehole and is followed by an eccentric bit 152 that rotates outward to drill a larger diameter hole. After reaching the desired depth, the drill string 154 is rotated in the opposite direction and extracted from the borehole leaving the drill casing 156 in situ to protect the integrity of the borehole sidewalls. Drilling can then be continued using the DTH hammer drill bit. Those of ordinary skill in the art will appreciate that this example is not intended to be limiting, and other methods of drilling can be used. For instance, if integrity of the borehole is not an issue, then the casing step can be omitted, and the DTH hammer drill can be utilized without the eccentric bit 152.

After pile extraction and drilling, the borehole is backfilled with a mixture of sand and water at ratios in accordance with the design documentation and ground surface conditions. Alternatively, the borehole can be backfilled with other suitable filler materials. Prior to backfilling, the top of the borehole can be formed with a rigid frame or casted with clay to protect the integrity of the borehole.

In cases where a ballast is required, the borehole is backfilled with a mixture of cementitious grout and water. If site conditions allow, the cementitious materials are added into the borehole dry, and water can be introduced after the borehole has been completely backfilled. The rigid hose permits introduction of water beneath the ground surface to facilitate mixing of the water with the cementitious material. During backfilling, reasonable precautions should be taken to minimize the amounts of native soil material that falls into the borehole; however, some amount of native material can be consolidated into the sand and water mixture.

The pile 104 is reinserted into the borehole and, if necessary, driven to depth. The vibratory actions of the pile driving equipment will aid with compaction and consolidation of the filler materials. A small amount of filler material may be displaced leaving a void at the top surface. The void can be filled in at a later time with additional filler material.

The process of extraction, drilling, and backfilling can be time-consuming and expensive and may require that the installation site be resurveyed. This leads to undesirable cost overruns and construction delays. The inventive methods disclosed herein provide an alternative to the time-consuming pile extraction and redrilling process. Rather than extracting a pile 104 when refusal is encountered, the ground surface surrounding the pile 104 can be side drilled by approaching the surface at an angle relative to the pile 104 using the appropriate drill.

Figure 9A:
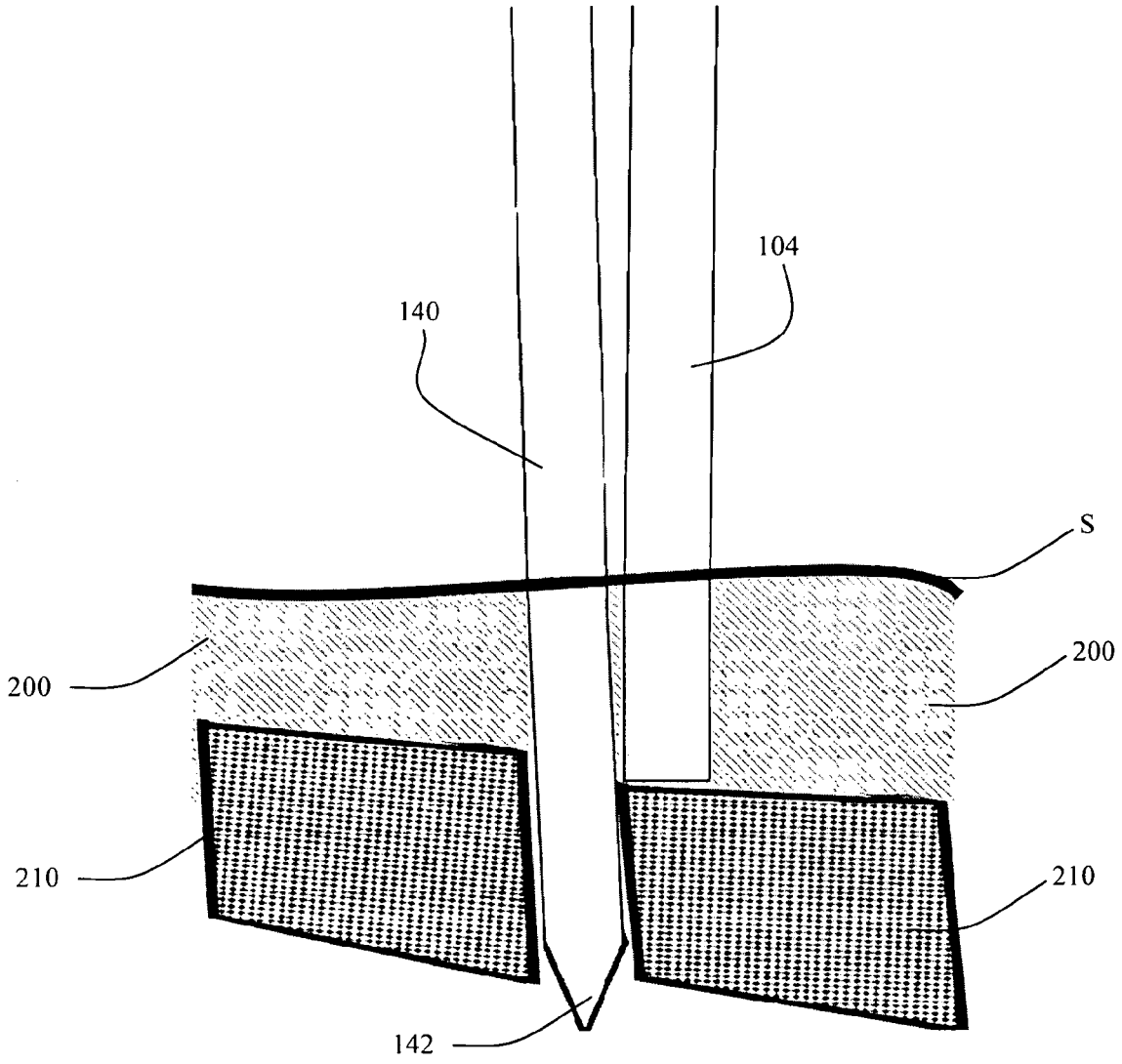
FIGS. 9A-9B depict an illustrative configurations for side-drilling through a refusal material.
Figure 9B:
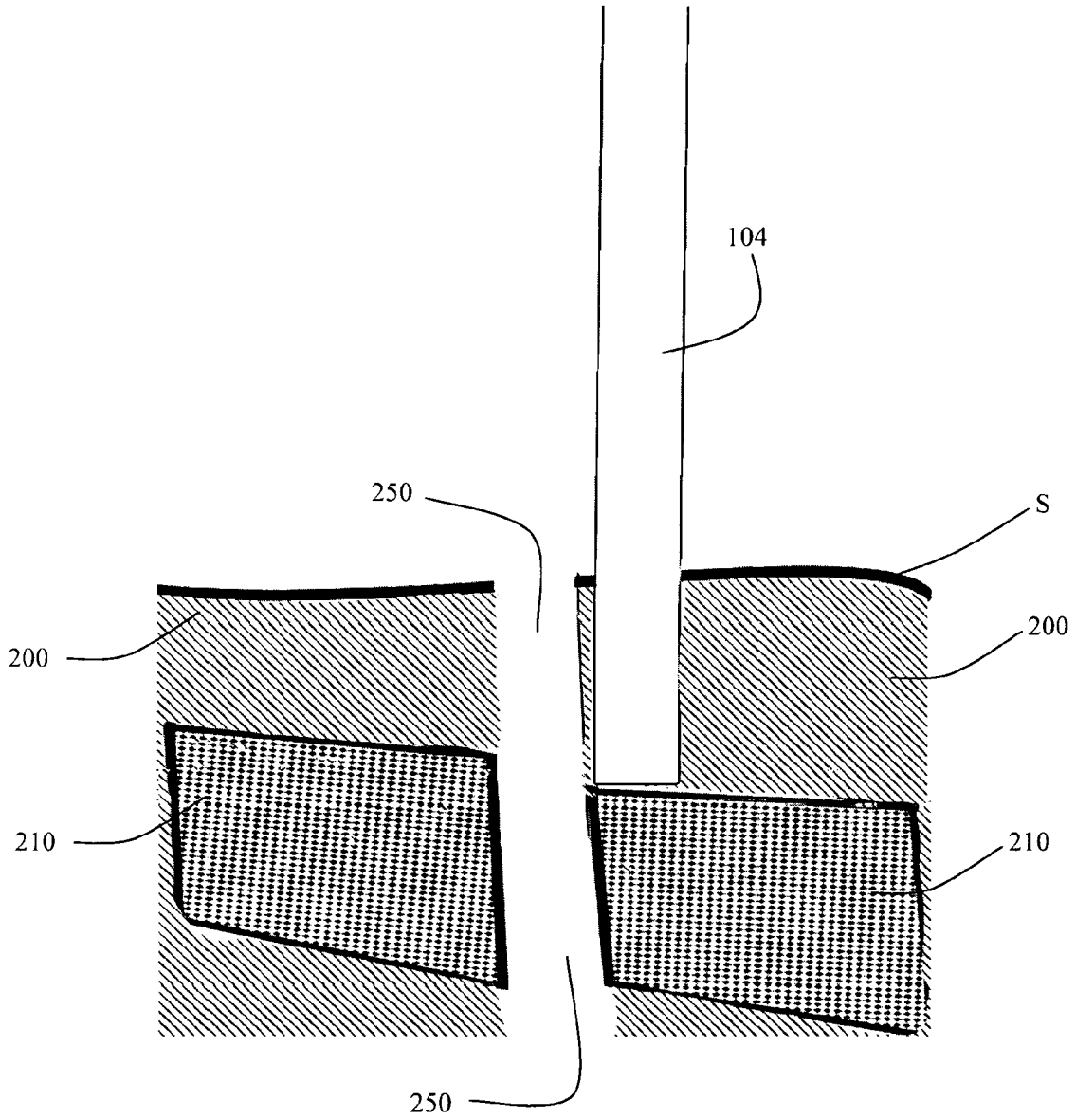

In one embodiment, the invention includes a process whereby traditional driving of the pile can be concomitantly accomplished with drilling. Side drilling pulverizes the refusal materials underneath the pile 104 and creates a void to receive pulverized refusal materials as the pile 104 is driven to depth. As shown in FIG. 9A pile 104 is driven below surface S through displaceable material 200 a certain depth until it encounters refusal material 210. Drill string 140 is driven downward at an angle such that its rotation causes drill bit 142 to pass through displaceable material 200 as well as bore and/or pulverize refusal material 210. Once extracted, drill string 140 and bit 142 leave bore 250 adjacent and beneath pile 104 (see FIG. 9B).

Refusal material 210 is now not supported as before and continued driving of pile 104 will cause refusal material 210 to be displaced into bore 250 since its structural integrity has now been compromised. The invention is not limited to the configuration shown in the figures however, and drill string 140 and bit 142 can bore into refusal material 210 at steeper or shallower angles than that shown.

Side drilling is preferably performed within six inches of the pile 104, and most preferably, as close as practical to the pile 104 without damaging it. Side drilling close to the pile 104 facilitates pulverization of the refusal materials and minimizes both the size of the resulting void and the removal of the native terrain. Solar tracker arrays are designed to meet predetermined wind load requirements considering native terrain conditions, among other factors. Thus, creating a void and removing the native terrain can negatively impact tracker array design.

For piles with an I-beam cross sectional shape, side drilling can be performed within the webbing of the pile (i.e., between the flanges). For example, a void can be created by drilling between the flanges of a six inch I-beam pile using a four inch DTH hammer drill bit. Use of a four inch drill bit minimizes the removal of native terrain. Additionally, drilling within the webbing minimizes the disturbance of native terrain on the outside of the pile 104 flanges, which act as load bearing surfaces during lateral load testing.

Side drilling is preferably accomplished with DTH hammer drills, which are generally more effective than auger or rotary drills at breaking up hard refusal materials. DTH hammer drills are also smaller and lighter than auger or rotary drills of comparable drilling capacity. Smaller drilling equipment reduces cost and is particularly advantageous for the installation of solar tracker arrays where piles may be installed close together (e.g., within twelve to sixteen feet), thus, limiting the mobility of drilling equipment. DTH hammer drills also utilize smooth drilling heads (see FIG. 10) and tungsten carbide button inserts 148 that minimize the risk of scoring galvanized piles.

One side of the pile 104 is side drilled until the drill reaches the embedment depth. Next, the pile 104 is driven to the embedment depth using the pile driving machine. If refusal material is encountered a second time, a second side of the pile 104 can be side drilled (e.g., the other side of the pile webbing) before attempting to redrive the pile 104 to the embedment depth. After driving the pile to embedment depth, the void created by side drilling can be backfilled using any suitable filler material. In one embodiment, the void is backfilled with dry cementitious material so that it is level with the existing ground surface. Water is introduced at ratios in accordance with the design documentation. Following the introduction of water, a small amount of settlement may occur. Additional backfill material can be added at a later time to fill in the resulting cavities.

Uplift and lateral pile load testing is performed after the backfill materials have set. Exemplary load test data is shown in Table 1 for six-inch I-beam piles driven to an embedment depth of six and a half feet.

TABLE 1

| | Load | | | | | | | | |
|---|---|---|---|---|---|---|---|---|---|
| | 0 | 250 | 500 | 750 | 1000 | 1250 | 1500 | | |
| | Hold Time | | | | | | | | |
| | 1 min | 1 min | 1 min | 1 min | 1 min | 1 min | 1 min | Lateral | Uplift |
| Ex. 1 | .000 | .000 | .000 | .000 | .001 | .002 | .006 | X | |
| Ex. 2 | .000 | .000 | .000 | .000 | .000 | .000 | .000 | | X |

In the embodiment shown in the attached figures, uplift load testing was conducted by applying a constant upward force to the top of the pile for one minute and measuring the resulting pile displacement in inches. For each round of testing, the applied force was increased from zero to fifteen hundred pounds per square inch in increments of two-hundred and fifty pounds per square inch. Similarly, lateral load testing was performed by applying a constant lateral force to the top of the pile for one minute and measuring the resulting displacement. Project specifications limited displacement to no more than one quarter inch. Both samples were well within project specifications. Overall, approximately ninety-five to ninety-eight percent of pile samples reinstalled (i.e., remediated) using the present side drilling method met or exceeded project load testing requirements relating to embedment, uplift, and lateral testing.

Although the foregoing description provides embodiments of the invention by way of example, it is envisioned that other embodiments may perform similar functions and/or achieve similar results. Any and all such equivalent embodiments and examples are within the scope of the present invention.

What is claimed is:

1. A method installing a pile comprising the steps of:
establishing a desired depth for a leading end of the pile;
driving a pile through a first substrate to a first position where the leading end of the pile contacts a second substrate at least partially comprising a refusal material;
drilling a bore with a drill string at an angle relative to the pile such that the leading end of the drill string creates a bore in the second substrate at a point below the leading end of the pile;
withdrawing the drill string; and
driving the pile into the bore created by the drill string.

2. The method of claim 1, wherein the drill string creates a bore extending to the desired depth for the leading end of the pile.

3. The method of claim 1, wherein the drill string creates a bore terminating at a point between the leading end of the pile when the pile is in the first position and the desired depth for the leading of the pile.

4. The method of claim 1, further comprising the step of driving the pile through the first and second substrates until the leading end of the pile reaches the desired depth.

5. The method of claim 1, wherein the pile is an I-Beam having a pair of flanges and the drill string drills a bore at an angle between the pair of flanges.

6. The method of claim 5, wherein the bore is drilled using a four (4) inch down-the-hole (DTH) hammer drill bit.

7. The method of claim 1 wherein the angle at which the drill string drills the bore is such that the drill string is within about six (6) inches of the pile at its closest point.

8. The method of claim 1 wherein the bore is drilled using a down-the-hole (DTH) hammer drill.

9. The method of claim 1 further comprising:
backfilling the bore with a cementitious material to a point level with the surface; and
applying water to the cementitious material.

10. A method installing a pile comprising the steps of:
establishing a desired depth for a leading end of the pile;
driving a pile through a first substrate to a first position where the leading end of the pile contacts a second substrate at least partially comprising a refusal material;
drilling a first bore with a drill string at an angle relative to the pile on a first side thereof such that the leading end of the drill string creates a first bore in the second substrate at a point below the leading end of the pile;
withdrawing the drill string; and
driving the pile through the second substrate to a second position where the leading end of the pile contacts a third substrate at least partially comprising a refusal material;
drilling a second bore with a drill string at an angle relative to the pile on a second side thereof such that the leading end of the drill string creates a second bore in the second substrate at a point below the leading end of the pile;
withdrawing the drill string from the second bore; and
driving the pile at least partially through the third substrate.

11. The method of claim 10, wherein the drill string creates a first bore extending to a point selected from the group consisting of the desired depth for the leading end of the pile and a point between the leading end of the pile when the pile is in the first position and the desired depth for the leading of the pile.

12. The method of claim 10, wherein the drill string creates a second bore extending to a point selected from the group consisting of the desired depth for the leading end of the pile and a point between the leading end of the pile when the pile is in the second position and the desired depth for the leading of the pile.

13. The method of claim 10, further comprising the step of driving the pile through the first, second and third substrates until the leading end of the pile reaches the desired depth.

14. The method of claim 10, wherein the pile is an I-Beam having a pair of flanges and the drill string drills a bore at an angle between the pair of flanges.

15. The method of claim 14, wherein the bore is drilled using a four (4) inch down-the-hole (DTH) hammer drill bit.

16. The method of claim 10 wherein the angle at which the drill string drills the bore is such that the drill string is within about six (6) inches of the pile at its closest point.

17. The method of claim 10 wherein the bore is drilled using a down-the-hole (DTH) hammer drill.

18. The method of claim 10 further comprising:
backfilling the first and second bores with a cementitious material to a point level with the surface; and applying water to the cementitious material in the first and second bores.

* * * * *